US011315474B2

(12) United States Patent
Wang

(10) Patent No.: US 11,315,474 B2
(45) Date of Patent: Apr. 26, 2022

(54) METHOD AND DEVICE FOR DRIVING DISPLAY PANEL, AND DISPLAY DEVICE

(71) Applicant: HKC CORPORATION LIMITED, Shenzhen (CN)

(72) Inventor: Mingliang Wang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 34 days.

(21) Appl. No.: 17/041,732

(22) PCT Filed: Dec. 24, 2018

(86) PCT No.: PCT/CN2018/123247
§ 371 (c)(1),
(2) Date: Sep. 25, 2020

(87) PCT Pub. No.: WO2020/118763
PCT Pub. Date: Jun. 18, 2020

(65) Prior Publication Data

US 2021/0366357 A1 Nov. 25, 2021

(30) Foreign Application Priority Data

Dec. 12, 2018 (CN) ..... 201811520735.1

(51) Int. Cl.
*G09G 3/36* (2006.01)
*G09G 3/20* (2006.01)

(52) U.S. Cl.
CPC ..... *G09G 3/2092* (2013.01); *G09G 3/3607* (2013.01); *G09G 2320/0247* (2013.01);
(Continued)

(58) Field of Classification Search
CPC ..... B60S 1/381; B60S 1/3863; B60S 1/3868; B60S 1/4003; B60S 1/4045; B60S 1/4048;
(Continued)

(56) References Cited

U.S. PATENT DOCUMENTS 5,815,135 A * 9/1998 Yui ..... G09G 5/399 345/97
2003/0179170 A1 9/2003 Lee
(Continued)

FOREIGN PATENT DOCUMENTS

CN 1617216 A 5/2005
CN 102148012 A 8/2011
(Continued)

OTHER PUBLICATIONS

First Office Action in counterpart Chinese Application No. 201811520735.1, dated Feb. 3, 2020.
(Continued)

*Primary Examiner* — Ram A Mistry
(74) *Attorney, Agent, or Firm* — Westbridge IP LLC

(57) ABSTRACT

Disclosed are a method and device for driving display panel, and a display device. The method includes: comparing original data of current frame and original data of previous frame to obtain a first difference value, converting the first difference value into a standard difference value through standard conversion, comparing processed data of current frame corresponding to each stage of plurality of stages of color processing with processed data of previous frame, to obtain a second difference value corresponding to each stage, and comparing the standard difference value with the second difference value corresponding to each stage, then outputting processed data of current frame of one corresponding stage according to the comparison results. As such
(Continued)

the driving chip (300) can drive the display panel according to the output data.

16 Claims, 3 Drawing Sheets

(52) U.S. Cl.
CPC ..... *G09G 2320/0666* (2013.01); *G09G 2320/0673* (2013.01); *G09G 2370/14* (2013.01)

(58) Field of Classification Search
CPC ..... B60S 1/4067; B60S 2001/4051; B60S 2001/4054; G09G 2320/0247; G09G 2320/0666; G09G 2320/0673; G09G 2370/14; G09G 3/2092; G09G 3/3607
See application file for complete search history.

(56) References Cited

U.S. PATENT DOCUMENTS

2004/0179002 A1 9/2004 Park et al.
2005/0151724 A1* 7/2005 Lin ..... G06F 3/0317 345/166
2008/0084432 A1* 4/2008 Jeon ..... G09G 3/3611 345/690
2010/0207953 A1* 8/2010 Kim ..... G09G 3/36 345/555
2012/0169784 A1* 7/2012 Lee ..... G09G 3/2011 345/690
2014/0111564 A1* 4/2014 Jeon ..... G09G 3/3648 345/691

FOREIGN PATENT DOCUMENTS

CN 105161047 A 12/2015
CN 105679269 A 6/2016
CN 105761695 A 7/2016
CN 105845094 A 8/2016
CN 107256693 A 10/2017
CN 108648692 A 10/2018
JP 2013195537 A 9/2013

OTHER PUBLICATIONS

International Search Report and Written Opinion in corresponding PCT Application No. PCT/CN2018/123247, dated Aug. 27, 2019.

* cited by examiner

METHOD AND DEVICE FOR DRIVING DISPLAY PANEL, AND DISPLAY DEVICE

CROSS-REFERENCE TO RELATED APPLICATIONS

The present disclosure is the National Stage of International Application No. PCT/CN2018/123247, filed on Dec. 24, 2018, which claims the priority of Chinese Patent Application No. 201811520735.1, entitled "METHOD AND DEVICE FOR DRIVING DISPLAY PANEL, AND DISPLAY DEVICE", filed on Dec. 12, 2018, which is hereby incorporated by reference in its entirety.

TECHNICAL FIELD

The present disclosure relates to the technical field of display, in particular to a method and a device for driving a display panel, and a display device.

BACKGROUND

At present, the display structure of television usually includes a Single On Chip (SOC) arranged on a main board and a Timing Controller (T-CON) chip arranged on a control board. The image input signal input by an antenna or a set-top box can be processed by SOC, and then transmitted to T-CON chip to be reprocessed. The data driving chip can drive the liquid crystal panel through the processed image input signal. The SOC chip is normally communicated with T-CON chip through a Low Voltage Differential Signaling (LVDS) transmission protocol. And the SOC chip can encode the received image signal according to the protocol and transmit the coded image signal to T-CON chip for a series of color processing. The processed image signal is at last transmitted to the driving unit to drive the liquid crystal display panel. The image input signal, however, may be greatly changed after being processed by SOC and T-CON chip. The current and previous display data at the same displaying point become absolutely different from each other especially for static display. Further, the more image input signal is subjected to the color processing, the more the display data will change, the more likely occurs the flickering.

SUMMARY

It is therefore one main objective of the disclosure to provide a method and device for driving a display panel, and a display device, aiming to solve the flicker phenomenon occurred in the screen displayed by the liquid crystal display panel in the existing technology.

In order to achieve the above objective, the embodiment of the present disclosure provides a method for driving display panel, the method includes the following operations:

receiving an original image signal, and comparing original data of a current frame of the original image signal with original data of a previous frame of the original image signal to obtain a first difference value;

color processing the original data of the current frame with a plurality of stages in sequence, and obtaining the processed data of the current frame corresponding to each stage, and converting the first difference value into a standard difference value through a standard conversion;

judging whether the standard difference value is greater than or equal to a preset value, if yes, outputting the processed data of the current frame corresponding to a last stage; if not, outputting the processed data of the current frame corresponding to one stage which has smallest difference with processed data of the previous frame; and driving the display panel according to the output data of the current frame.

Optionally, the operation of the operation of outputting the processed data of the current frame corresponding to one stage which has smallest difference with processed data of the previous frame includes:

comparing the processed data of the current frame corresponding to each stage with the processed data of the previous frame, and obtaining a second difference value corresponding to each stage; and comparing the standard difference value with the second difference value corresponding to each stage, and outputting the processed data of the current frame corresponding to the second difference value which is less than or equal to the standard difference value.

Optionally, the operation of outputting the processed data of the current frame corresponding to the second difference value which is less than or equal to the standard difference value includes:

outputting the processed data of the current frame corresponding to the second difference value corresponding to the stage, when the second difference value corresponding to one stage is less than or equal to the standard difference value; and outputting the processed data of the current frame corresponding to the second difference value corresponding to the last stage, when the second difference values corresponding to two or more of stages are less than or equal to the standard difference.

Optionally, the operation of comparing the standard difference value with the second difference value corresponding to each stage, and outputting the processed data of the current frame corresponding to the second difference value which is less than or equal to the standard difference value, further includes:

outputting the processed data of the previous frame, when the second difference value corresponding to each stage is greater than the standard difference value.

Optionally, the operation of color processing the original data of the current frame with a plurality of stages in sequence, and obtaining the processed data of the current frame corresponding to each stage includes:

pigment processing, processed data a1 of the current frame corresponding to a first stage is obtained by the pigment processing on the original data of the current frame;

digital gamma processing, processed data a2 of the current frame corresponding to a second stage is obtained by the digital gamma processing on the original data of the current frame; and dithering processing, processed data a3 of the current frame corresponding to a third stage is obtained by the dithering processing on the original data of the current frame.

Optionally, the digital gamma processing includes:

adjusting transmitted image data in a digital way, and editing a gamma curve of the image data to perform a non-linear hue editing on the image; and detecting a dark part and a light part of an image signal, increasing a proportion of the dark part and the light part.

Optionally, the operation of comparing the processed data of the current frame corresponding to each stage with the processed data of the previous frame, and obtaining a second difference value corresponding to each stage includes:

taking the pigment processing as the first stage of the color processing, the pigment processing is configured to receive and process the original data of the current frame after decoding and obtain the processed data a1 of the current frame corresponding to the first stage, and compare the processed data a1 of the current frame corresponding to the first stage with the processed data b of the previous frame to obtain a difference, then record the difference as the second difference value Δ2 of the first stage; and transmitting the processed data a1 of the current frame corresponding to the first stage to the second stage of the color processing;

taking the digital gamma processing as the second stage of the color processing, the digital gamma processing is configured to receive and process the processed data a1 of the current frame corresponding to the first stage, and obtain the processed data a2 of the current frame corresponding to the second stage, and compare the processed data a2 of the current frame corresponding to the second stage with the processed data b of the previous frame to obtain a difference, and record the difference as the second difference value Δ2 of the second stage; and transmitting the processed data a2 of the current frame corresponding to the second stage to the third stage of the color processing; and taking the dithering processing as the third stage of the color processing, the dithering processing is configured to receive and process the processed data a2 of the current frame corresponding to the second stage, and obtain the processed data a3 of the current frame corresponding to the third stage, and compare the processed data a3 of the current frame corresponding to the third stage with the processed data b of the previous frame to obtain a difference, and record the difference as the second difference value Δ2 of the third stage; and storing and setting the processed data a3 of the current frame corresponding to the third stage as a comparison basis for processed data of a next frame obtained from the plurality of stages of the color processing.

Optionally, the operation of receiving the original image signal, and comparing original data of the current frame of the original image signal with original data of the previous frame of the original image signal to obtain the first difference value, further includes:

combining the original data of the current frame and the first difference value, encoding and transmitting the combined original data and first difference value according to a preset protocol, then decoding the combined original data and first difference value.

Optionally, the operation of combining the original data of the current frame and the first difference value, encoding and transmitting the combined original data and first difference value according to the preset protocol, then decoding the combined original data and first difference value, includes: dividing, according to color, the original data of the current frame into red primary color data including AR0 to AR7, green primary color data including AG0 to AG7, and blue primary color data including AB0 to AB7, each primary color data has eight bits; and dividing, according to the color, the first difference value Δ 1 into a red primary color data difference value, a green primary color data difference value, and a blue primary color data difference value, each of the primary color data difference values has three bits.

Optionally, the preset protocol is a low voltage differential signal transmission protocol, and the low voltage differential signal includes four pairs of differential signals corresponding to the original data of the current frame, and one pair of differential signals corresponding to the first difference value.

The present disclosure further provides a device for driving display panel, which includes:

a main control chip, configured to receive an original image signal, and compare original data of a current frame of the original image signal with original data of a previous frame of the original image signal to obtain a first difference value; the main control chip is also configured to combine the original data of the current frame and the first difference value, and code and transmit the combined original data and first difference value according to a preset protocol;

a timing controller chip, communicated to the main control chip through the preset protocol, and configured to receive and decode the coded original data and first difference value, to separate the original data of the current frame and the first difference value out; the timing controller chip is configured to perform plurality of stages of color processing on the original data of the current frame in sequence to obtain processed data of the current frame corresponding to each stage, and convert the first difference value into a standard difference value through a standard conversion, then judge whether the standard difference value is greater than or equal to a preset value, if yes, the timing controller chip is configured to output the processed data of the current frame corresponding to a last stage of plurality of stages of color processing; if not, the timing controller chip is also configured to compare the processed data of the current frame corresponding to each stage and the processed data of the previous frame, and obtain a second difference value corresponding to each stage, and compare the standard difference value with the second difference value corresponding to each stage, then output the processed data of the current frame corresponding to the second difference value which is less than or equal to the standard difference value; and a driving chip, connected to an output end of the timing controller chip, and is configured to drive the display panel according to the processed data of the current frame output by the timing controller chip.

Optionally, outputting the processed data of the current frame corresponding to the second difference value corresponding to the stage, when the second difference value corresponding to one stage is less than or equal to the standard difference value; outputting the processed data of the current frame corresponding to the second difference value corresponding to the last stage, when the second difference values corresponding to two or more of stages are less than or equal to the standard difference; and outputting the processed data of the previous frame, when the second difference value corresponding to each stage is greater than the standard difference value.

Optionally, when the second difference value corresponding to each stage is greater than the standard difference value, outputting the processed data of the previous frame.

Optionally, the preset protocol is a low voltage differential signal transmission protocol, and the low voltage differential signal includes four pairs of differential signals corresponding to the original data of the current frame, and one pair of differential signals corresponding to the first difference value.

Optionally, the timing controller chip is further configured to compare the processed data of the current frame corresponding to each stage with the processed data of the previous frame, and obtain the second difference value corresponding to each stage; and the timing controller chip is also configured to compare the standard difference value with the second difference value corresponding to each stage, and output the processed data of the current frame corresponding to the second difference value which is less than or equal to the standard difference value.

The embodiment of the present disclosure further provides a display device, which includes a display panel and a device for driving the display panel; the device for driving the display panel includes:

a main control chip, configured to receive an original image signal, and compare original data of a current frame of the original image signal with original data of a previous frame of the original image signal to obtain a first difference value; the main control chip is also configured to combine the original data of the current frame and the first difference value, and code and transmit the combined original data and first difference value according to a preset protocol;

a timing controller chip, communicated to the main control chip through the preset protocol, and configured to receive and decode the coded original data and first difference value, to separate the original data of the current frame and the first difference value out; the timing controller chip is configured to perform plurality of stages of color processing on the original data of the current frame in sequence to obtain processed data of the current frame corresponding to each stage, and convert the first difference value into a standard difference value through a standard conversion, then judge whether the standard difference value is greater than or equal to a preset value, if yes, the timing controller chip is configured to output the processed data of the current frame corresponding to a last stage of plurality of stages of color processing; if not, the timing controller chip is also configured to compare the processed data of the current frame corresponding to each stage and the processed data of the previous frame, and obtain a second difference value corresponding to each stage, and compare the standard difference value with the second difference value corresponding to each stage, then output the processed data of the current frame corresponding to the second difference value which is less than or equal to the standard difference value; and a driving chip, connected to an output end of the timing controller chip, and is configured to drive the display panel according to the processed data of the current frame output by the timing controller chip.

The embodiments of the present disclosure provide at least one technical solutions, which have the following technical effect or advantages:

the main control chip is configured to compare the original data of the current frame and the original data of the previous frame to obtain the first difference value, and transmit the first difference value and the original data of the current frame to the timing controller chip, the timing controller chip is configured to convert the first difference value into the standard difference value through the standard conversion, and obtain the second difference value corresponding to each stage of plurality of stages of color processing through comparing the processed data of the current frame corresponding to each stage with the processed data of the previous frame, and compare the standard difference value with the second difference value corresponding to each stage, then output processed data of current frame of one corresponding stage according to the comparison results, and the driving chip can output driving signal to the display according to the data output by the timing controller chip. When the transmitted image is a static frame, the effect of processing the data received by the display panel can be ensured through the above technical solution, and the flicker phenomenon in the display panel is also solved.

BRIEF DESCRIPTION OF THE DRAWINGS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

The realizing of the aim, functional characteristics, advantages of the present disclosure are further described in detail with reference to the accompanying drawings and the embodiments.

DETAILED DESCRIPTION OF EMBODIMENTS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all of the directional instructions in the embodiments of the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

Figure 1:
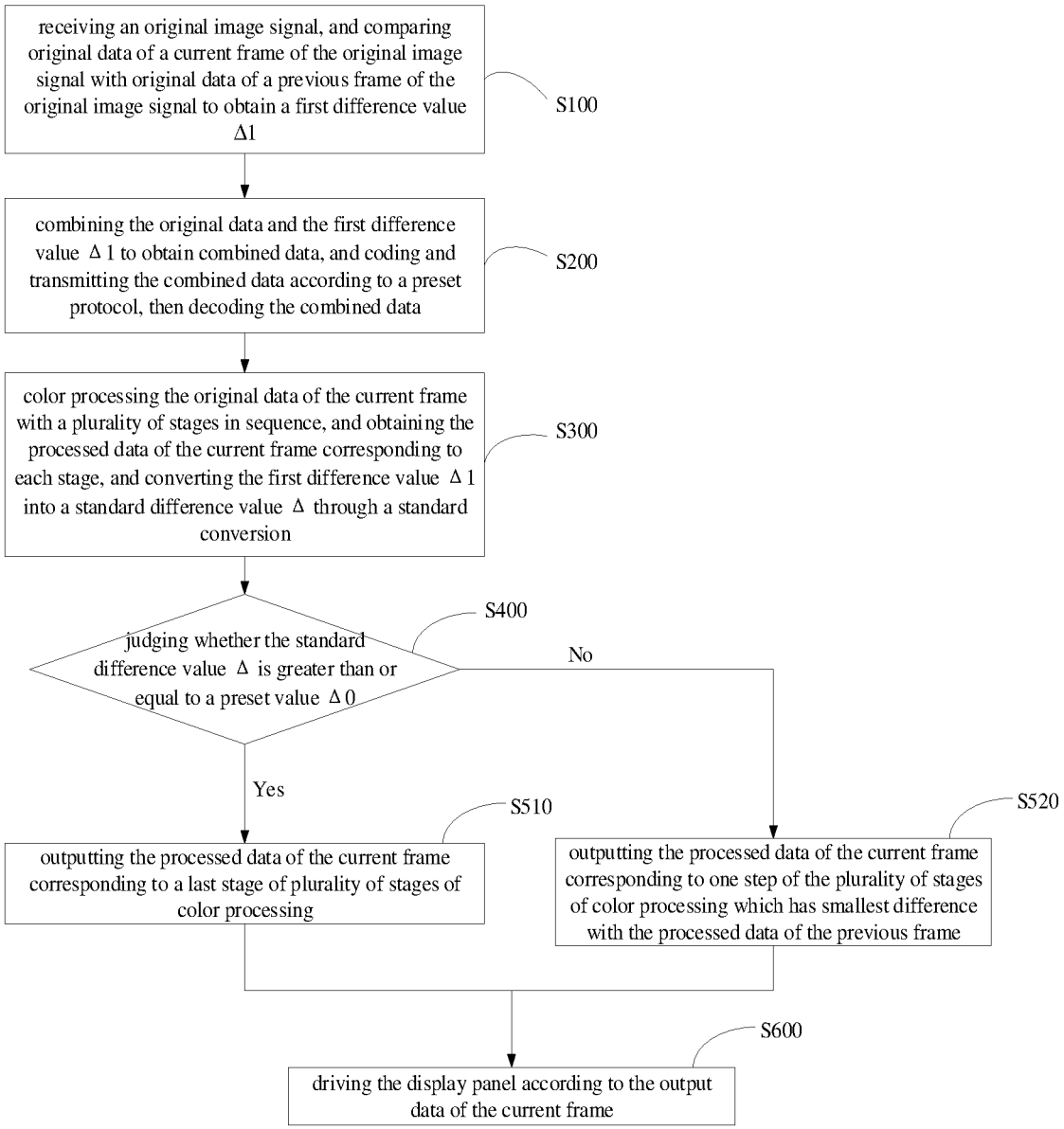
FIG. 1 is a flow chart diagram of a method for driving a display panel according to an embodiment of the present disclosure.

In one embodiment, referring to FIG. 1, the embodiment of the present disclosure provides a method for driving a display panel, the method includes the following operations:

S100, receiving an original image signal, and comparing original data of a current frame of the original image signal with original data of a previous frame of the original image signal to obtain a first difference value Δ1;

S200, combining the original data and the first difference value Δ1 to obtain combined data, and coding and transmitting the combined data according to a preset protocol, then decoding the combined data;

S300, color processing the original data of the current frame with a plurality of stages in sequence, and obtaining the processed data of the current frame corresponding to each stage, and converting the first difference value Δ1 into a standard difference value Δ through a standard conversion;

S400, judging whether the standard difference value Δ is greater than or equal to a preset value Δ0;

S510, if yes, outputting the processed data of the current frame corresponding to a last stage of plurality of stages of color processing;

S520, if not, outputting the processed data of the current frame corresponding to one step of the plurality of stages of color processing which has smallest difference with the processed data of the previous frame;

S600, driving the display panel according to the output data of the current frame.

Figure 2:
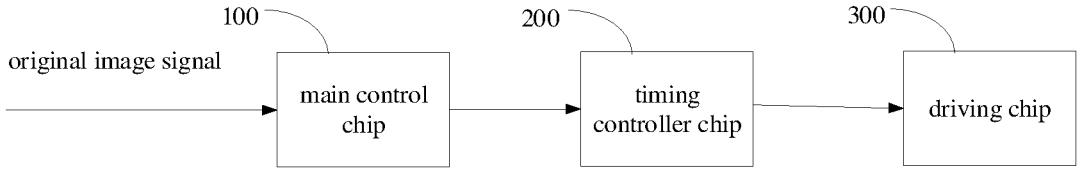
FIG. 2 is a block diagram of a device for driving display panel according to an embodiment of the present disclosure.

In the embodiment, referring to FIG. 2, the display panel can normally be a liquid crystal display panel of an electronic device having a display function such as a television or a computer, and the driving method is performed based on a driving device for the liquid crystal display panel. Taking the television as an example, the driving device of the display panel is mainly composed of a main control chip 100 arranged on a main board, a timing controller chip 200 arranged on the control board, and a driving chip 300, and the main control chip 100, the timing controller chip 200, and the driving chip 300 are connected with each other in sequence. The main control chip 100 is communicated with the timing controller chip 200 through LVDS transmission protocol.

Optionally, an input end of the main control chip 100 is configured to receive the original data of the current frame of the original image signal, the original image signal is usually transmitted and input into the input end of the main control chip 100 by an antenna or a set-top box. The main control chip 100 stores original data of a previous frame of the original image signal, and acquires a difference value between the original data of the previous frame and the original data of the current frame, and defines the difference value as the first difference value Δ1. The main control chip 100 is further configured to combine the original data of the current frame and the first difference value Δ1, and transmit the combined original data and the first difference value Δ1 according to the LVDS transmission protocol.

The LVDS in the LVDS transmission protocol includes four pairs of differential signals corresponding to the original data of the current frame, and one pair of differential signals corresponding to the first difference value.

Optionally, the color of the original data of the current frame can also be preliminarily processed before combining, coding, and transmitting the original data of the current frame and the first difference value Δ1.

Figure 3:
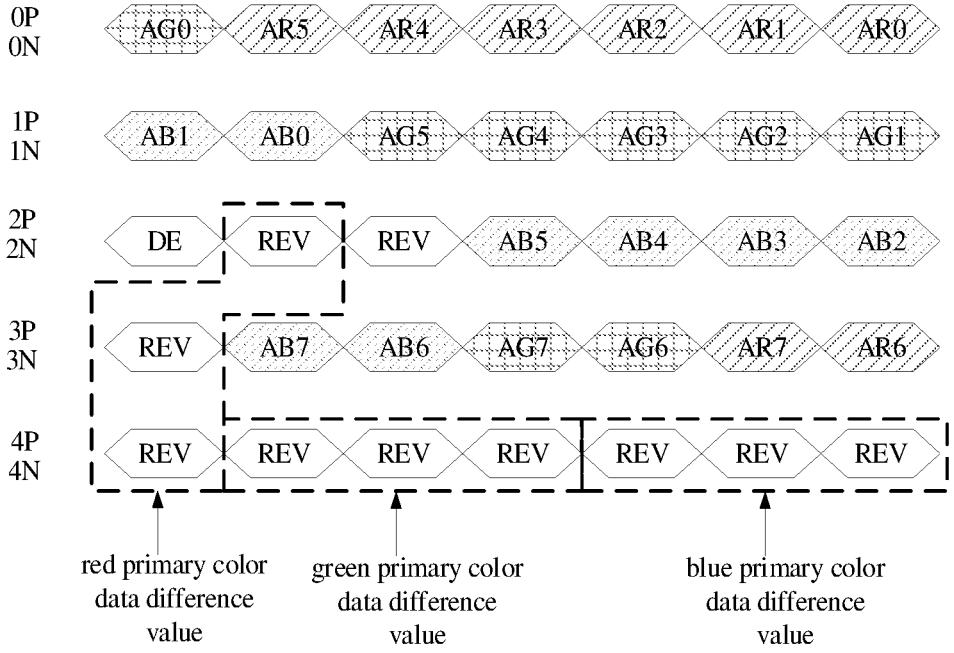
FIG. 3 is a transmission protocol schematic coding diagram of a low voltage differential signal of a driving device of the display panel of the present disclosure.

Referring to FIG. 3, in S200, the operation of combining the original data and the first difference value Δ1 to obtain combined data, and coding and transmitting the combined data according to the preset protocol, then decoding the combined data, includes: dividing the original data of the current frame into red primary color data, green primary color data, and blue primary color data according to color, each of the primary color data has eight bits, the red primary color data includes AR0 to AR7, the green primary color data includes AG0 to AG7, and the blue primary color data includes AB0 to AB7; and dividing the first difference value Δ1 into a red primary color data difference value, a green primary color data difference value, and a blue primary color data difference value according to the color, and each of the primary color data difference values has three bits.

In the embodiment, the first pair of differential signals (0P, 0N) sequentially transmit AR0 to AR5 of the red primary color data and AG0 of the green primary color data. The second pair of differential signals (1P, 1N) sequentially transmit AG0 to AG5 of the green primary color data and AB0 to AB1 of the blue primary color data. The third pair of differential signals (2P, 2N) sequentially transmit AB2 to AB5 of the blue primary color data, and an enable signal DE, and two reserved data bits REV are arranged between the enable signal DE and AB5 of blue primary color data. The fourth pair of differential signals (3P, 3N) sequentially transmit AR6 to AR7 of the red primary color data, AG6 to AG7 of the green primary color data, and AB6 to AB7 of the blue primary color data, and the fourth pair of differential signals (3P, 3N) further have one reserved data bit REV. The fifth pair of differential signals (4P, 4N) are all reserved data bits REV. Then the red primary color data difference value, the green primary color data difference value and the blue primary color data difference value are transmitted through seven reserved data bits REV of the fifth pair of differential signals (4P, 4N), one reserved data bit REV of the fourth pair of differential signals (3P, 3N), and one reserved data bit REV of the third pair of differential signals (2P, 2N) together.

In one embodiment, each of the primary color data difference values can be represented in binary, and then every three bits can represent eight data difference values (i.e., 0 to 7), which can be represented according to the following encoding forms: 000 represents that the primary color data difference value is 0, 001 represents that the primary color data difference value is 1, 010 represents that the primary color data difference value is 2, 011 represents that the primary color data difference value is 3, 100 represents that the primary color data difference value is 4, 101 represents that the primary color data difference value is 5, 110 represents that the primary color data difference value is 6, 111 represents that the primary color data difference value is 7. When the data difference value is greater than 7, the data difference value is also defaulted to 7. For example, when the red primary color data difference value is 2, the transmission bit of the red primary color data difference value is 010; when the green primary color data difference value is 4, the transmission bit of the green primary color data difference value is 100; when the blue primary color data difference value is 1, the transmission bit of the blue primary color data difference value is 001. Each of the primary color data difference values of the first difference value Δ1 can be coded with reference to the above coding rule, and there is no example here.

After the original data of the current frame and the first difference value Δ1 are encoded according to the above protocol, the coded original data and first difference value Δ1 are transmitted to the timing controller chip 200, then the coded original data and first difference value Δ1 are encoded according to the to LVDS transmission protocol, for separating the original data of the current frame and the first difference value Δ1 out, then the original data of the current frame is subjected to the plurality of stages of color processing, meanwhile the first difference value Δ1 is subjected to a standard conversion processing.

There are many kinds of plurality of stages of color processing. In the embodiment, the plurality of stages of color processing including a pigment processing, a digital gamma processing, and a dithering processing are taken as an example, and the pigment processing, the digital gamma processing, and the dithering processing are sequentially performed. The plurality of stages of color processing are not limited to the form exemplified in the embodiment. The pigment processing is configured to improve the color vividness of the transmitted image data, and the original data of the current frame is subjected to pigment processing to obtain the processed data a1 of the current frame corresponding to the first stage. The digital gamma processing adopts a digital mode to adjust the transmitted image data, and edits the gamma curve of the image data to carry out a non-linear hue editing on the image, when the dark part and the light part in the image signal are detected, and the proportion of the dark part and the light part is increased so as to improve the image contrast effect, the processed data a2 of the current frame corresponding to the second stage is obtained by subjecting the original data of the current frame to the digital gamma processing. The dithering processing includes a de-dithering processing, the image subjected to the de-dithering processing can display more gray scales to make the image transition smoother. The processed data a3 of the current frame corresponding to the third stage is obtained by subjecting the original data of the current frame to the dithering processing.

In the embodiment, the first difference value Δ1 can be converted into the standard difference value Δ according to the following standard table.

| First difference value Δ1 | Standard difference value Δ |
|---|---|
| 0 | 0 |
| 1 | 1 |
| 2 | 3 |
| 3 | 4 |
| 4 | 5 |
| 5 | NA |
| 6 | NA |
| 7 | NA |

In the standard table, NA in the column of the standard difference value Δ represents that the frame difference is too large and would not be processed. In the embodiment, the preset value Δ0 is set to be 5, and if the first difference value Δ1 is greater than or equal to 5, it is considered that the frame difference is too large and no processing is performed. That is, the current frame is a dynamic frame, and the processed data of the current frame corresponding to the last stage (i.e., the data a3 corresponding to the dither processing) is directly output and transmitted to the driving chip 300, and the driving chip 300 outputs a corresponding driving signal to the display panel according to the data a3.

Figure 4:
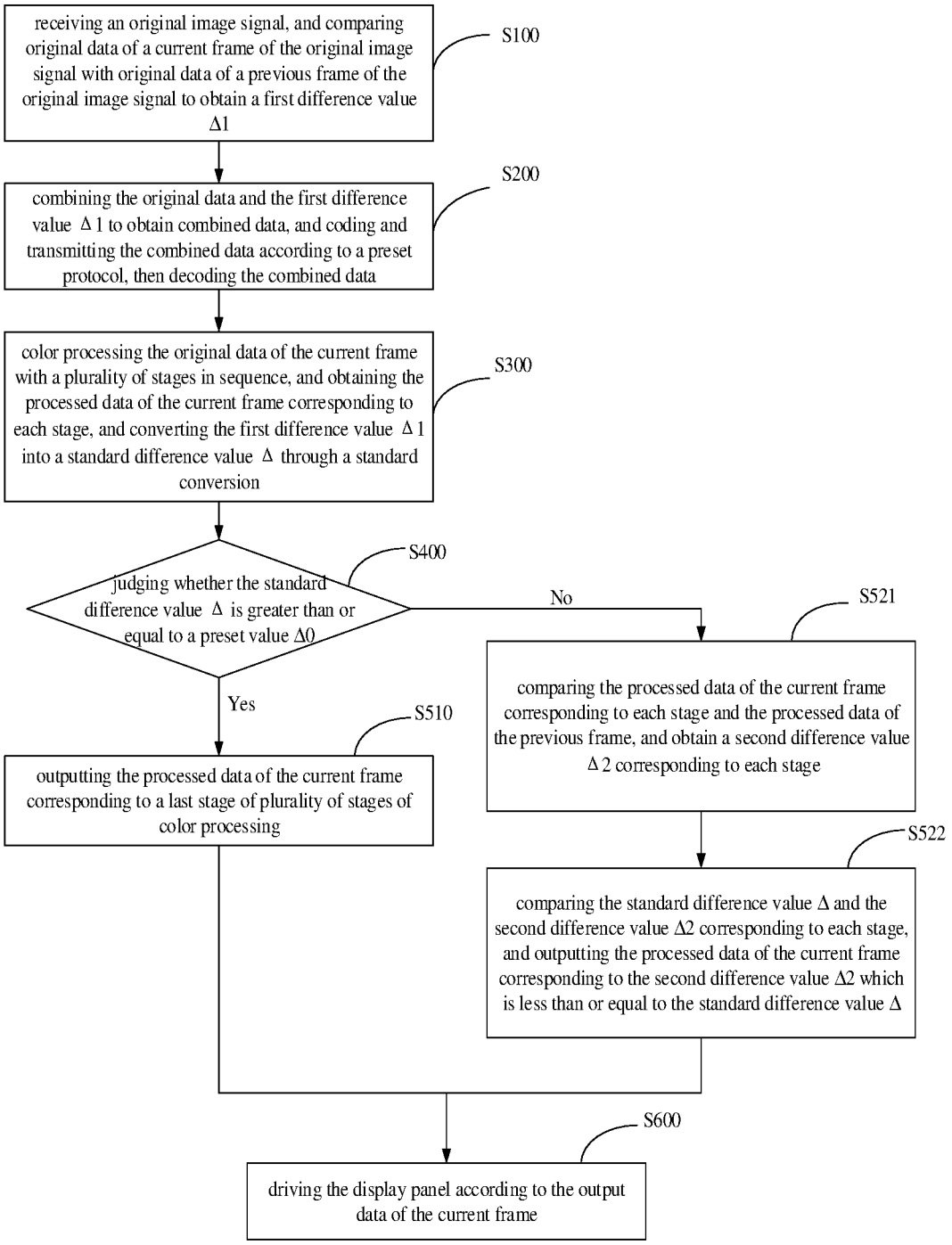
FIG. 4 is a flow chart diagram of a method for driving a display panel according to another embodiment of the present disclosure.

Referring to FIG. 4, if the first difference value Δ1 is less than 5, the current frame is determined to be a static frame, and S520 can be performed according to the following operations:

S521, comparing the processed data of the current frame corresponding to each stage and the processed data of the previous frame, and obtain a second difference value Δ2 corresponding to each stage; and S522, comparing the standard difference value Δ and the second difference value Δ2 corresponding to each stage, and outputting the processed data of the current frame corresponding to the second difference value Δ2 which is less than or equal to the standard difference value Δ.

In S521, the processed data (a1, a2, a3) of the current frame obtained by orderly subjecting the original data of the current frame to the plurality of stages of color processing is compared with the processed data b of the previous frame obtained by subjecting the original data of the previous frame to the plurality of stages of color processing, the detail operation is described as follows.

The pigment processing is served as a first stage of the plurality of stages of color processing. The pigment processing is configured to receive and process the decoded original data of the current frame, to obtain the processed data a1 of the current frame corresponding to the first stage, and compare the processed data a1 of the current frame corresponding to the first stage with the processed data b of the previous frame to obtain the difference value which is recorded as the second difference value Δ 2 of the first stage. Meanwhile, the pigment processing is also configured to transmit the processed data a1 of the current frame corresponding to the first stage to a next stage of the plurality of stages of color processing.

Correspondingly, the second stage of plurality of stages of color processing (i.e., the digital gamma processing) is configured to receive the processed data a1 of the current frame corresponding to the first stage output through the first stage, and process the processed data a1 of the current frame corresponding to the first stage to obtain the processed data a2 of the current frame corresponding to the second stage, and compare the processed data a2 of the current frame corresponding to the second stage with the processed data b of the previous frame, to obtains the difference value which is recorded as the second difference value Δ 2 of the second stage. Meanwhile, the digital gamma processing is also configured to transmit the processed data a2 of the current frame corresponding to the second stage to a next stage of the plurality of stages of color processing.

Correspondingly, the third stage of the plurality of stages color processing process (i.e., the dithering process) is configured to receive the processed data a2 of the current frame corresponding to the second stage output through the second stage, and process the processed data a2 of the current frame corresponding to the second stage to obtain the processed data a3 of the current frame corresponding to the third stage, and compare the processed data a3 of the current frame corresponding to the third stage with the processed data b of the previous frame, to obtain the difference value which can be recorded as the second difference value Δ 2 of the third stage. Meanwhile, the dithering process is also configured to store and set the processed data a3 of the current frame corresponding to the third stage as a comparison basis for processed data of a next frame obtained from the plurality of stages of the color processing.

In operation S522, the second difference value Δ 2 corresponding to each stage is compared with the standard difference value Δ. According to the comparison results, several situations are classified as follows.

When the second difference value Δ 2 corresponding to one stage of the plurality of stages of color processing is less than or equal to the standard difference value Δ, the processed data of the current frame corresponding to the second difference value Δ2 is output to the driving chip 300. For example, when the second difference value Δ 2 corresponding to the pigment processing is less than or equal to the standard difference value Δ, and the second difference values Δ 2 corresponding to the digital gamma processing and the dithering processing are greater than the standard difference value Δ, the processed data a1 of the current frame corresponding to the first stage is selected and transmitted to the driving chip 300, and the driving chip 300 outputs the corresponding driving signal to the display panel according to the processed data a1. Of course, the second difference value Δ 2 corresponding to the digital gamma processing or the dithering processing may also be less than or equal to the standard difference value Δ, and the specific processing method is carried out with reference to the above-mentioned pigment processing process, which is not exemplified here.

When the second difference values Δ 2 corresponding to two or more stages of plurality of stages of color processing are less than or equal to the standard difference value Δ, the processed data of the current frame corresponding to the second difference value Δ 2 of the latter stage is selected and transmitted to the driving chip 300. For example, when the second difference values Δ 2 corresponding to the pigment processing and the digital gamma unit processing are both less than or equal to the standard difference value Δ, and the second difference value Δ 2 corresponding to the dithering processing is greater than the standard difference value Δ, the processed data a2 corresponding to a latter stage of the plurality of stages of color processing is transmitted to the driving chip 300, and the driving chip 300 outputs the corresponding driving signal to the display panel according to the processed data a2. Of course, there may also be cases where the second difference values Δ 2 corresponding to the other two or more stages of plurality of stages of color processing are less than or equal to the standard difference value Δ, and the specific processing method is carried out with reference to the above embodiments, and there is no example here.

When the second difference value Δ 2 corresponding to each stage of the plurality of stages of the color processing is greater than the standard difference value Δ, the processed data of the previous frame is selected and transmitted to the driving chip 300. For example, when the second difference values Δ 2 corresponding to the pigment processing, the digital gamma processing, and the dithering processing are all greater than the standard difference value Δ, the data obtained by performing the plurality of stages of color processing on the original data of the previous frame is transmitted to the driving chip 300, and the driving chip 300 outputs the driving signal to the display panel according to the data.

When the transmitted image is a static frame, the processing effect of processing the data received by the display panel can be ensured through the driving method, and the flicker phenomenon of the display panel is also solved.

In one embodiment, referring to FIG. 2, the embodiment of the present disclosure provides a device for driving a display panel, the display panel can usually be a liquid crystal display panel of an electronic device having a display function such as a television or a computer. Taking the television as an example, the device for driving the display panel is mainly composed of a main control chip 100 arranged on a main board, a timing controller chip 200 arranged on the control board, and a driving chip 300, the main control chip 100, the timing controller chip 200, and the driving chip 300 are connected with each other in sequence. The main control chip 100 is communicated with the timing controller chip 200 through a transmission protocol of low voltage differential signaling (LVDS).

Optionally, an input end of the main control chip 100 is configured to receive the original data of the current frame of the original image signal, the original image signal is usually transmitted and input into the input end of the main control chip 100 by an antenna or a set-top box. The main control chip 100 stores original data of a previous frame of the original image signal, and acquires a difference value between the original data of the previous frame with the original data of the current frame, and defines the difference value as the first difference value Δ 1. The main control chip 100 is further configured to combine the original data of the current frame and the first difference value Δ 1 for transmitting the combined data according to the LVDS transmission protocol.

The LVDS in the LVDS transmission protocol includes four pairs of differential signals corresponding to the original data of the current frame, and one pair of differential signals corresponding to the first difference value.

Optionally, the color of the original data of the current frame can also be preliminarily processed before combining, coding, and transmitting the original data of the current frame and the first difference value Δ1.

Referring to FIG. 3, the operation of combining the original data and the first difference value Δ1 to obtain combined data, and coding and transmitting the combined data according to the preset protocol, then decoding the combined data includes: dividing the original data of the current frame into red primary color data, green primary color data, and blue primary color data according to color, each of the primary color data has eight bits, the red primary color data includes AR0 to AR7, the green primary color data includes AG0 to AG7, and the blue primary color data includes AB0 to AB7; and dividing the first difference value Δ1 into a red primary color data difference value, a green primary color data difference value, and a blue primary color data difference value according to the color, and each of the primary color data difference values has three bits.

In the embodiment, the first pair of differential signals (0P, 0N) sequentially transmit AR0 to AR5 of the red primary color data and AG0 of the green primary color data. The second pair of differential signals (1P, 1N) sequentially transmit AG0 to AG5 of the green primary color data and AB0 to AB1 of the blue primary color data. The third pair of differential signals (2P, 2N) sequentially transmit AB2 to AB5 of the blue primary color data, and an enable signal DE, and two reserved data bits REV are arranged between the enable signal DE and AB5 of blue primary color data. The fourth pair of differential signals (3P, 3N) sequentially transmit AR6 to AR7 of the red primary color data, AG6 to AG7 of the green primary color data, and AB6 to AB7 of the blue primary color data, and the fourth pair of differential signals (3P, 3N) further have one reserved data bit REV. The fifth pair of differential signals (4P, 4N) are all reserved data bits REV. Then the red primary color data difference value, the green primary color data difference value and the blue primary color data difference value are transmitted through seven reserved data bits REV of the fifth pair of differential signals (4P, 4N), one reserved data bit REV of the fourth pair of differential signals (3P, 3N), and one reserved data bit REV of the third pair of differential signals (2P, 2N) together.

In one embodiment, each of the primary color data difference values can be represented in binary, and then every three bits can represent eight data difference values (i.e., 0 to 7), which can be represented according to the following encoding forms: 000 represents that the primary color data difference value is 0, 001 represents that the primary color data difference value is 1, 010 represents that the primary color data difference value is 2, 011 represents that the primary color data difference value is 3, 100 represents that the primary color data difference value is 4, 101 represents that the primary color data difference value is 5, 110 represents that the primary color data difference value is 6, 111 represents that the primary color data difference value is 7. When the data difference value is greater than 7, the data difference value is also defaulted to 7. For example, when the red primary color data difference value is 2, the transmission bit of the red primary color data difference value is 010; when the green primary color data difference value is 4, the transmission bit of the green primary color data difference value is 100; when the blue primary color data difference value is 1, the transmission bit of the blue primary color data difference value is 001. Each of the primary color data difference values of the first difference value Δ1 can be coded with reference to the above coding rule, and there is no example here.

After the original data of the current frame and the first difference value Δ1 are encoded according to the above protocol, the coded original data and first difference value Δ1 are transmitted to the timing controller chip 200, then the coded original data and first difference value Δ1 are encoded according to the to LVDS transmission protocol, for separating the original data of the current frame and the first difference value Δ1 out, then the original data of the current frame is subjected to the plurality of stages of color processing, meanwhile the first difference value Δ1 is subjected to a standard conversion processing.

There are many kinds of plurality of stages of color processing. In the embodiment, the plurality of stages of color processing including a pigment processing, a digital gamma processing, and a dithering processing are taken as an example, and the pigment processing, the digital gamma processing, and the dithering processing are sequentially performed. The plurality of stages of color processing are not limited to the form exemplified in the embodiment. The pigment processing is configured to improve the color vividness of the transmitted image data, and the original data of the current frame is subjected to pigment processing to obtain the processed data a1 of the current frame corresponding to the first stage. The digital gamma processing adopts a digital mode to adjust the transmitted image data, and edits the gamma curve of the image data to carry out a non-linear hue editing on the image, when the dark part and the light part in the image signal are detected, and the proportion of the dark part and the light part is increased so as to improve the image contrast effect, the processed data a2 of the current frame corresponding to the second stage is obtained by subjecting the original data of the current frame to the digital gamma processing. The dithering processing includes a de-dithering processing, the image subjected to the de-dithering processing can display more gray scales to make the image transition smoother. The processed data a3 of the current frame corresponding to the third stage is obtained by subjecting the original data of the current frame to the dithering processing.

In the embodiment, the first difference value Δ1 can be converted into the standard difference value Δ according to the following standard table.

| First difference value Δ1 | Standard difference value Δ |
|---|---|
| 0 | 0 |
| 1 | 1 |
| 2 | 3 |
| 3 | 4 |

-continued

| First difference value Δ1 | Standard difference value Δ |
|---|---|
| 4 | 5 |
| 5 | NA |
| 6 | NA |
| 7 | NA |

In the standard table, NA in the column of the standard difference value Δ represents that the frame difference is too large and would not be processed. In the embodiment, the preset value Δ0 is set to be 5, and if the first difference value Δ1 is greater than or equal to 5, it is considered that the frame difference is too large and no processing is performed. That is, the current frame is a dynamic frame, and the processed data of the current frame corresponding to the last stage (i.e., the data a3 corresponding to the dither processing) is directly output and transmitted to the driving chip 300, and the driving chip 300 outputs a corresponding driving signal to the display panel according to the data a3.

Referring to FIG. 4, if the first difference value Δ1 is less than 5, the current frame is determined to be a static frame, and the operation of outputting the processed data of the current frame corresponding to one step which has smallest difference with processed data of the previous frame can be performed according to the following operations:

comparing the processed data of the current frame corresponding to each stage with the processed data of the previous frame, to obtain a second difference value Δ2 corresponding to each stage; and comparing the standard difference value Δ with the second difference value Δ2 corresponding to each stag, and outputting the processed data of the current frame corresponding to the second difference value Δ2 which is less than or equal to the standard difference value Δ.

The processed data (a1, a2, a3) of the current frame obtained by orderly subjecting the original data of the current frame to the plurality of stages of color processing is compared with the processed data b of the previous frame obtained by subjecting the original data of the previous frame to the plurality of stages of color processing, the detail operation is described as follows.

The pigment processing is served as a first stage of the plurality of stages of color processing. The pigment processing is configured to receive and process the decoded original data of the current frame, to obtain the processed data a1 of the current frame corresponding to the first stage, and compare the processed data a1 of the current frame corresponding to the first stage with the processed data b of the previous frame to obtain the difference value which is recorded as the second difference value Δ2 of the first stage. Meanwhile, the pigment processing is also configured to transmit the processed data a1 of the current frame corresponding to the first stage to a next stage of the plurality of stages of color processing.

Correspondingly, the second stage of plurality of stages of color processing (i.e., the digital gamma processing) is configured to receive the processed data a1 of the current frame corresponding to the first stage output through the first stage, and process the processed data a1 of the current frame corresponding to the first stage to obtain the processed data a2 of the current frame corresponding to the second stage, and compare the processed data a2 of the current frame corresponding to the second stage with the processed data b of the previous frame, to obtains the difference value which is recorded as the second difference value Δ2 of the second stage. Meanwhile, the digital gamma processing is also configured to transmit the processed data a2 of the current frame corresponding to the second stage to a next stage of the plurality of stages of color processing.

Correspondingly, the third stage of the plurality of stages color processing process (i.e., the dithering process) is configured to receive the processed data a2 of the current frame corresponding to the second stage output through the second stage, and process the processed data a2 of the current frame corresponding to the second stage to obtain the processed data a3 of the current frame corresponding to the third stage, and compare the processed data a3 of the current frame corresponding to the third stage with the processed data b of the previous frame, to obtain the difference value which can be recorded as the second difference value Δ2 of the third stage. Meanwhile, the dithering process is also configured to store and set the processed data a3 of the current frame corresponding to the third stage as a comparison basis for processed data of a next frame obtained from the plurality of stages of the color processing.

The second difference value Δ2 of each stage is compared with the standard difference value Δ. According to the comparison results, several situations are classified as follows.

When the second difference value Δ2 corresponding to one stage of the plurality of stages of color processing is less than or equal to the standard difference value Δ, the processed data of the current frame corresponding to the second difference value Δ2 is output to the driving chip 300. For example, when the second difference value Δ2 corresponding to the pigment processing is less than or equal to the standard difference value Δ, and the second difference values Δ2 corresponding to the digital gamma processing and the dithering processing are greater than the standard difference value Δ, the processed data a1 of the current frame corresponding to the first stage is selected and transmitted to the driving chip 300, and the driving chip 300 outputs the corresponding driving signal to the display panel according to the processed data a1. Of course, the second difference value Δ2 corresponding to the digital gamma processing or the dithering processing may also be less than or equal to the standard difference value Δ, and the specific processing method is carried out with reference to the above-mentioned pigment processing process, which is not exemplified here.

When the second difference values Δ2 corresponding to two or more stages of plurality of stages of color processing are less than or equal to the standard difference value Δ, the processed data of the current frame corresponding to the second difference value Δ2 of the latter stage is selected and transmitted to the driving chip 300. For example, when the second difference values Δ2 corresponding to the pigment processing and the digital gamma unit processing are both less than or equal to the standard difference value Δ, and the second difference value Δ2 corresponding to the dithering processing is greater than the standard difference value Δ, the processed data a2 corresponding to a latter stage of the plurality of stages of color processing is transmitted to the driving chip 300, and the driving chip 300 outputs the corresponding driving signal to the display panel according to the processed data a2. Of course, there may also be cases where the second difference values Δ2 corresponding to the other two or more stages of plurality of stages of color processing are less than or equal to the standard difference value Δ, and the specific processing method is carried out with reference to the above embodiments, and there is no example here.

When the second difference value Δ2 corresponding to each stage of the plurality of stages of the color processing is greater than the standard difference value Δ, the processed data of the previous frame is selected and transmitted to the driving chip 300. For example, when the second difference values Δ2 corresponding to the pigment processing, the digital gamma processing, and the dithering processing are all greater than the standard difference value Δ, the data obtained by performing the plurality of stages of color processing on the original data of the previous frame is transmitted to the driving chip 300, and the driving chip 300 outputs the driving signal to the display panel according to the data.

When the transmitted image is a static frame, the effect of processing the data received by the display panel can be ensured through the driving device, and the flicker phenomenon of the display panel is also solved.

In one embodiment, the embodiment of the present disclosure also provides a display device based on the same application concept, the display device includes a display panel and the above-mentioned device for driving the display panel. The structure, working principle and beneficial effects of the device for driving the display panel can be referred to the foregoing embodiments and will not be described here again.

The foregoing description merely depicts some embodiments of the present application and therefore is not intended to limit the scope of the present disclosure. An equivalent structural or flow changes made by using the content of the specification and drawings of the present application, or any direct or indirect applications of the disclosure on any other related fields shall all fall in the scope of the application.

What is claimed is:

1. A method for driving a display panel, comprising:

receiving an original image signal, and comparing original data of a current frame of the original image signal with original data of a previous frame of the original image signal to obtain a first difference value;

color processing the original data of the current frame with a plurality of stages in sequence, and obtaining the color processed data of the current frame corresponding to each stage of the plurality of stages, and converting the first difference value into a standard difference value through a standard conversion;

judging whether the standard difference value is greater than or equal to a preset value, if yes, outputting the color processed data of the current frame corresponding to a last stage of the plurality of stages; if not, outputting the color processed data of the current frame corresponding to one stage of the plurality of stages which has smallest difference with the color processed data of the previous frame; and driving the display panel according to the output data of the current frame.

2. The method according to claim 1, wherein the operation of outputting the color processed data of the current frame corresponding to one stage of the plurality of stages which has smallest difference with the color processed data of the previous frame, comprises:

comparing the color processed data of the current frame corresponding to each stage of the plurality of stages with the color processed data of the previous frame, and obtaining a second difference value corresponding to each stage of the plurality of stages; and comparing the standard difference value with the second difference value corresponding to each stage of the plurality of stages, and outputting the color processed data of the current frame corresponding to the second difference value which is less than or equal to the standard difference value.

3. The method according to claim 2, wherein the operation of outputting the color processed data of the current frame corresponding to the second difference value which is less than or equal to the standard difference value, comprises:

outputting the color processed data of the current frame corresponding to the second difference value corresponding to the stage of the plurality of stages, when the second difference value corresponding to one stage of the plurality of stages is less than or equal to the standard difference value; and outputting the color processed data of the current frame corresponding to the second difference value corresponding to the last stage of the plurality of stages, when the second difference values corresponding to two or more of stages of the plurality of stages are less than or equal to the standard difference.

4. The method according to claim 3, wherein the operation of comparing the standard difference value with the second difference value corresponding to each stage of the plurality of stages, and outputting the color processed data of the current frame corresponding to the second difference value which is less than or equal to the standard difference value, further comprises:

outputting the color processed data of the previous frame, when the second difference value corresponding to each stage of the plurality of stages is greater than the standard difference value.

5. The method according to claim 2, wherein the operation of color processing the original data of the current frame with a plurality of stages in sequence, and obtaining the color processed data of the current frame corresponding to each stage of the plurality of stages, comprises:

pigment processing, color processed data a1 of the current frame corresponding to a first stage of the plurality of stages is obtained by the pigment processing on the original data of the current frame;

digital gamma processing, color processed data a2 of the current frame corresponding to a second stage of the plurality of stages is obtained by the digital gamma processing on the original data of the current frame; and dithering processing, color processed data a3 of the current frame corresponding to a third stage of the plurality of stages is obtained by the dithering processing on the original data of the current frame.

6. The method according to claim 5, wherein the digital gamma processing comprises:

adjusting transmitted image data in a digital way, and editing a gamma curve of the image data to perform a non-linear hue editing on the image; and detecting a dark part and a light part of an image signal, increasing a proportion of the dark part and the light part.

7. The method according to claim 5, wherein the operation of comparing the color processed data of the current frame corresponding to each stage of the plurality of stages with the color processed data of the previous frame, and obtaining a second difference value corresponding to each stage of the plurality of stages, comprises:

taking the pigment processing as the first stage of the plurality of stages of the color processing, wherein the pigment processing is configured to receive and process the original data of the current frame after decoding and obtain the color processed data a1 of the current frame corresponding to the first stage of the plurality of stages, and compare the color processed data a1 of the current frame corresponding to the first stage of the plurality of stages with the color processed data b of the previous frame to obtain a difference, then record the difference as the second difference value Δ2 of the first stage of the plurality of stages; and transmitting the color processed data a1 of the current frame corresponding to the first stage of the plurality of stages to the second stage of the plurality of stages of the color processing;

taking the digital gamma processing as the second stage of the plurality of stages of the color processing, wherein the digital gamma processing is configured to receive and process the color processed data a1 of the current frame corresponding to the first stage of the plurality of stages, and obtain the color processed data a2 of the current frame corresponding to the second stage of the plurality of stages, and compare the color processed data a2 of the current frame corresponding to the second stage of the plurality of stages with the color processed data b of the previous frame to obtain a difference, and record the difference as the second difference value Δ2 of the second stage of the plurality of stages; and transmitting the color processed data a2 of the current frame corresponding to the second stage of the plurality of stages to the third stage of the plurality of stages of the color processing; and taking the dithering processing as the third stage of the plurality of stages of the color processing, wherein the dithering processing is configured to receive and process the color processed data a2 of the current frame corresponding to the second stage of the plurality of stages, and obtain the color processed data a3 of the current frame corresponding to the third stage of the plurality of stages, and compare the color processed data a3 of the current frame corresponding to the third stage of the plurality of stages with the color processed data b of the previous frame to obtain a difference, and record the difference as the second difference value Δ2 of the third stage of the plurality of stages; and storing and setting the color processed data a3 of the current frame corresponding to the third stage of the plurality of stages as a comparison basis for color processed data of a next frame obtained from the plurality of stages of the color processing.

8. The method according to claim 1, wherein after the operation of receiving the original image signal, and comparing original data of the current frame of the original image signal with original data of the previous frame of the original image signal to obtain the first difference value, the method further comprises:

combining the original data of the current frame and the first difference value, encoding and transmitting the combined original data and first difference value according to a preset protocol, then decoding the combined original data and first difference value.

9. The method according to claim 8, wherein the operation of combining the original data of the current frame and the first difference value, encoding and transmitting the combined original data and first difference value according to the preset protocol, then decoding the combined original data and first difference value, comprises:

dividing, according to color, the original data of the current frame into red primary color data comprising AR0 to AR7, green primary color data comprising AG0 to AG7, and blue primary color data comprising AB0 to AB7, wherein each primary color data has eight bits; and dividing, according to the color, the first difference value Δ1 into a red primary color data difference value, a green primary color data difference value, and a blue primary color data difference value, wherein each of the primary color data difference values has three bits.

10. The method according to claim 9, wherein the preset protocol is a low voltage differential signal transmission protocol, and the low voltage differential signal comprises four pairs of differential signals corresponding to the original data of the current frame, and one pair of differential signals corresponding to the first difference value.

11. A device for driving a display panel, comprising:

a main control chip, configured to receive an original image signal, and compare original data of a current frame of the original image signal with original data of a previous frame of the original image signal to obtain a first difference value; the main control chip is also configured to combine the original data of the current frame and the first difference value, and code and transmit the combined original data and first difference value according to a preset protocol;

a timing controller chip, communicated to the main control chip through the preset protocol, and configured to receive and decode the coded original data and first difference value, to separate the original data of the current frame and the first difference value out; wherein the timing controller chip is configured to perform a plurality of stages of color processing on the original data of the current frame in sequence to obtain the color processed data of the current frame corresponding to each stage of the plurality of stages, and convert the first difference value into a standard difference value through a standard conversion, then judge whether the standard difference value is greater than or equal to a preset value, if yes, the timing controller chip is configured to output the color processed data of the current frame corresponding to a last stage of the plurality of stages of color processing; if not, the timing controller chip is also configured to compare the color processed data of the current frame corresponding to each stage of the plurality of stages and the color processed data of the previous frame, and obtain a second difference value corresponding to each stage of the plurality of stages, and compare the standard difference value with the second difference value corresponding to each stage of the plurality of stages, then output the color processed data of the current frame corresponding to the second difference value which is less than or equal to the standard difference value; and a driving chip, connected to an output end of the timing controller chip, and is configured to drive the display panel according to the color processed data of the current frame output by the timing controller chip.

12. The device according to claim 11, wherein the timing controller chip is further configured to: output the color processed data of the current frame corresponding to the second difference value corresponding to the stage of the plurality of stages, when the second difference value corresponding to one stage of the plurality of stages is less than or equal to the standard difference value; output the color processed data of the current frame corresponding to the second difference value corresponding to the last stage of the plurality of stages, when the second difference values corresponding to two or more of stages of the plurality of stages are less than or equal to the standard difference; and output the color processed data of the previous frame, when the second difference value corresponding to each stage of the plurality of stages is greater than the standard difference value.

13. The device according to claim 11, wherein the preset protocol is a low voltage differential signal transmission protocol, and the low voltage differential signal comprises four pairs of differential signals corresponding to the original data of the current frame, and one pair of differential signals corresponding to the first difference value.

14. A display device, wherein the display device comprises a display panel and a device for driving the display panel; the device for driving the display panel comprises:

a main control chip, configured to receive an original image signal, and compare original data of a current frame of the original image signal with original data of a previous frame of the original image signal to obtain a first difference value; the main control chip is also configured to combine the original data of the current frame and the first difference value, and code and transmit the combined original data and first difference value according to a preset protocol;

a timing controller chip, communicated to the main control chip through the preset protocol, and configured to receive and decode the coded original data and first difference value, to separate the original data of the current frame and the first difference value out; wherein the timing controller chip is configured to perform a plurality of stages of color processing on the original data of the current frame in sequence to obtain the color processed data of the current frame corresponding to each stage of the plurality of stages, and convert the first difference value into a standard difference value through a standard conversion, then judge whether the standard difference value is greater than or equal to a preset value, if yes, the timing controller chip is configured to output the color processed data of the current frame corresponding to a last stage of the plurality of stages of color processing; if not, the timing controller chip is also configured to compare the color processed data of the current frame corresponding to each stage of the plurality of stages and the color processed data of the previous frame, and obtain a second difference value corresponding to each stage of the plurality of stages, and compare the standard difference value with the second difference value corresponding to each stage of the plurality of stages, then output the color processed data of the current frame corresponding to the second difference value which is less than or equal to the standard difference value; and a driving chip, connected to an output end of the timing controller chip, and is configured to drive the display panel according to the color processed data of the current frame output by the timing controller chip.

15. The display device according to claim 14, wherein the timing controller chip is further configured to: output the color processed data of the current frame corresponding to the second difference value corresponding to the stage of the plurality of stages, when the second difference value corresponding to one stage of the plurality of stages is less than or equal to the standard difference value; output the color processed data of the current frame corresponding to the second difference value corresponding to the last stage of the plurality of stages, when the second difference values corresponding to two or more of stages of the plurality of stages are less than or equal to the standard difference; and output the color processed data of the previous frame, when the second difference value corresponding to each stage of the plurality of stages is greater than the standard difference value.

16. The display device according to claim 14, wherein the preset protocol is a low voltage differential signal transmission protocol, and the low voltage differential signal comprises four pairs of differential signals corresponding to the original data of the current frame, and one pair of differential signals corresponding to the first difference value.

* * * * *